US005886468A

United States Patent [19]

Terada et al.

[11] Patent Number: 5,886,468

[45] Date of Patent: Mar. 23, 1999

[54] FLUORESCENT LAMP

[75] Inventors: Toshiyuki Terada, Tokyo; Kazuaki Kawasaki, Kanagawa-ken, both of Japan

[73] Assignee: Stanley Electric Co., Ltd., Tokyo, Japan

[21] Appl. No.: 928,833

[22] Filed: Sep. 12, 1997

[30] Foreign Application Priority Data

Feb. 7, 1997 [JP] Japan ..... 9-025048

[51] Int. Cl.[6] ..... H01J 61/35

[52] U.S. Cl. ..... 313/607; 313/234; 313/594; 313/493

[58] Field of Search ..... 313/607, 234, 313/594, 113, 493, 573

[56] References Cited

U.S. PATENT DOCUMENTS 4,871,941 10/1989 Dobashi et al. ..... 313/607 X
5,030,894 7/1991 Yoshiike et al. ..... 313/607 X
5,256,935 10/1993 Dobashi et al. ..... 313/607 X
5,514,932 5/1996 Willibrodus et al. ..... 313/113 X

*Primary Examiner*—Ashok Patel
*Attorney, Agent, or Firm*—Weingarten, Schurgin, Gagnebin & Hayes LLP

[57] ABSTRACT

In the fluorescent lamp of the present invention, a fluorescent layer and a reflection layer are formed on an inner surface of a tubular glass bulb such that the reflection layer is formed between the glass bulb and the fluorescent layer, and the open angle of opening portions formed in the fluorescent layer and the refection layer is made smaller than that formed in the external electrode. Thereby, reflection efficiency is improved, thereby making it possible to increase the amount of light with the same power consumption. Since the independent reflection layer is formed and the external electrode does not need to serve as a reflector, flexibility is given to the setting of the area of the external electrode, whereby power consumption is set freely.

7 Claims, 1 Drawing Sheet

FLUORESCENT LAMP

BACKGROUND OF THE INVENTION

1. Field of the Invention

This invention relates to a fluorescent lamp and, more specifically, to a fluorescent lamp comprising an internal electrode provided inside a tubular glass bulb, an external electrode formed on an outer surface of the glass bulb, and a fluorescent layer formed on an inner surface of the glass bulb wherein the inside of the glass bulb is filled with a rare gas and the fluorescent layer is excited by ultraviolet light generated by discharge in the rare gas to emit light.

2. Background Art

FIG. 2 shows a configuration of this type of fluorescent lamp 90 of the prior art, which comprises a tubular glass bulb 91, an internal electrode 92, an external electrode 93, and a fluorescent layer 94. Inside the tubular glass bulb 91 which is sealed at both ends, the internal electrode 92 is provided at the center of the bulb 91 and a rare gas 93 is filled. The fluorescent layer 94 is formed on the inner surface of the glass bulb by suitable means such as coating. The external electrode 95 which also functions as a reflector is formed on the outer surface of the glass bulb 91 by affixing an aluminum foil, for example. Opening portions 94*a* and 95*a* each of which has an opening angle $\alpha 0$ from the center of the glass bulb 91 are formed in the fluorescent layer 94 and the external electrode 95 at the same position, respectively. Thus, the area of the formed fluorescent layer 94 is outwardly and indirectly covered with the area of the external electrode 95.

When voltage is applied between the internal electrode 92 and the external electrode 95 of the fluorescent lamp 90 configured as described above, discharge occurs between the both electrodes 92 and 95, whereby the fluorescent layer 94 is excited to emit the light which is radiated outward from the opening portions 94*a* and 95*a*. At this point, the light emitted from the fluorescent layer 94 to the glass bulb 91 is reflected by the external electrode 95, returns, passes through the fluorescent layer 94 and is radiated from the opening portions 94*a* and 95*a*.

However, in the fluorescent lamp 90 of the prior art configured as described above, the light emitted from the fluorescent layer 94 to the glass bulb 91 goes and returns within the glass bulb 91, thereby the light is attenuated by absorption by the glass bulb 91 and the amount of the light taken out from the opening portions 94*a* and 95*a* becomes smaller than the real amount of the light emitted from the fluorescent layer 94.

When the function thereof as a reflector is given priority because the external electrode 95 also functions as a reflector, the optimal area of the external electrode 95 cannot be set, resulting its excessive power consumption. Conversely, when the function thereof as an external electrode is given priority, the area of the reflector becomes short. Thus, requirements from the two functions conflict with each other, thereby making the optimal design difficult.

SUMMARY OF THE INVENTION

It is, accordingly, an object of the present invention to overcome the disadvantages in the prior art fluorescent lamp by providing a fluorescent lamp comprising a tubular glass bulb, an internal electrode provided inside the tubular glass bulb, a fluorescent layer formed on an inner surface of the glass bulb, and an external electrode formed on an outer surface of the glass bulb, wherein opening portions having predetermined opening angles from the center of the glass bulb are formed in the fluorescent layer and the external electrode in an axial direction of the glass bulb at the same position, respectively, the fluorescent lamp further comprises a reflection layer formed on the inner surface of the glass bulb between the fluorescent layer and the glass bulb and having the same area as that of the fluorescent layer, and the opening angle of the opening portions formed in the fluorescent layer and the refection layer is made smaller than that formed in the external electrode.

In the present invention, preferably the reflection layer comprises a dielectric compound, such as $BaTiO_3$, $TiO_2$, or $BaSO_4$.

In addition, in the present invention the external electrode may be made of a material having no reflection function but having an electrode function, such as a conductive paint.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
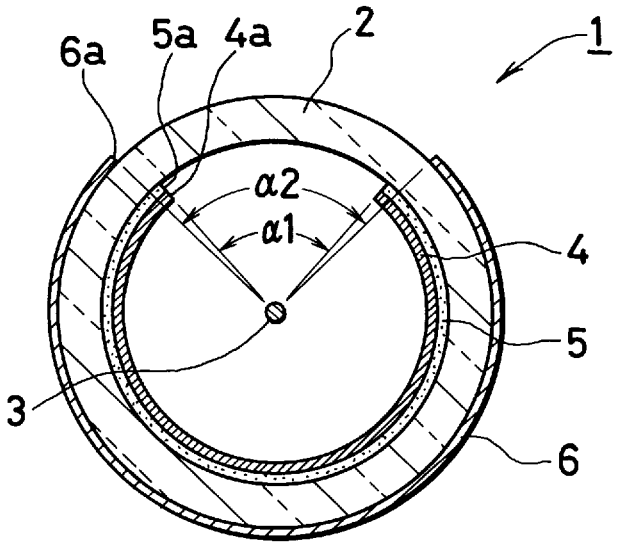
FIG. 1 is a sectional view of a fluorescent lamp according to an embodiment of the present invention.

The present invention is described in detail hereinafter with reference to an embodiment shown in the drawing. In FIG. 1, reference numeral 1 denotes a fluorescent lamp according to the present invention. This fluorescent lamp 1 comprises a tubular glass bulb 2, an internal electrode 3 provided inside the tubular glass bulb 2, a fluorescent layer 4 formed on an inner surface of the tubular glass bulb 2, and an external electrode 6 formed on an outer surface of the glass bulb 2 like the prior art.

A fluorescent layer opening portion 4*a* having an opening angle $\alpha 1$ is formed in the fluorescent layer 4 and an electrode opening portion 6*a* having an opening angle $\alpha 2$ is formed in the external electrode 6 so that the light emitted from the fluorescent layer 4 provided on the inner surface of the tubular glass bulb 2 can be radiated to the outside of the tubular glass bulb 2 like the prior art.

In the present invention, a reflection layer 5 is independently formed on the inner surface of the glass bulb 2 in addition to the fluorescent layer 4. The reflection layer 5 is formed on the inner surface of the glass bulb 2 so as to be in close contact with the inner surface of the glass bulb 2 and the fluorescent layer 4 is further provided on the reflection layer 5.

Describing the reflection layer 5 in more detail, in the present invention, the reflection layer 5 does not have any function as an external electrode and only needs to reflect the light emitted from the fluorescent layer to the tubular glass bulb 2 unlike the prior art.

Therefore, the reflection layer 5 does not need to have any conductivity and only needs to have excellent reflection performance. In addition, the material for the reflection layer 5 can be selected from anything which has excellent reflection performance, but preferably, which has a dielectric property at the same time. Examples for the dielectric compound as the reflection layer 5 includes $BaTiO_3$, $TiO_2$, and $BaSO_4$. In the present invention, as the reflection layer 5 can be prepared from a liquid containing white pigments or white powders such as $TiO_2$ or $BaTiO_3$, an appropriate binder, and a solvent, the layer 5 can be formed and processed by completely the same steps as the fluorescent layer 4.

After the reflection layer 5 is first formed on the inner surface of the glass bulb 2 and subjected to a suitable treatment such as preliminary drying if required, the fluorescent layer 4 is formed by almost the same steps and then a trimming treatment for forming a fluorescent layer opening portion 4*a* in the fluorescent layer is carried out. A reflection layer opening portion 5*a* having the same opening angle α1 as that of the fluorescent layer 4 is formed in the reflection layer 5 simultaneously with the formation of the fluorescent layer opening portion 4*a* in the fluorescent layer 4.

In the present invention, the external electrode 6 is also formed on the outer surface of the glass bulb 2. Since the reflection layer 5 is formed as described above, the external electrode 6 does not need to have a reflection function. Therefore, any material having no reflection function, such as a conductive paint, can be used, and the external electrode 6 can be formed by a simple process such as printing.

According to the fluorescent lamp 1 of the present invention configured as described above, since the reflection layer 5 is formed on the inner surface of the glass bulb 2, namely between the glass bulb 2 and the fluorescent layer 4, light radiated toward the glass bulb 2 from the fluorescent layer 4 is immediately reflected by the adjacent reflection layer 5 and does not reach the glass bulb 2.

Therefore, since neither a light loss caused by passage through the glass bulb 2 nor a light loss caused by reflection generated by the difference of refractive index between medias, i.e. the glass bulb 2 and the member in contact with the glass bulb 2, at the interface therebetween occurs, the reflection efficiency of light radiated toward the glass bulb 2 from the fluorescent layer 4 is improved.

In addition, since the reflection layer 5 is formed, the external electrode 6 does not need to serve as a reflector and the area thereof can be freely set. In other words, when the external electrode 6 also serves as a reflector, it must cover the entire area of the fluorescent layer 4. On the contrary, when the reflection layer 5 is present, the external electrode 6 does not need to cover the entire area of the fluorescent layer 4 and the area of the external electrode 6 can be determined only depending on the functions of the external electrode 6. In addition, since the external electrode 6 does not need to be serve as a reflector any material having no reflection function but having an electrode function can be widely used as the external electrode 6.

EXAMPLE

Figure 2:
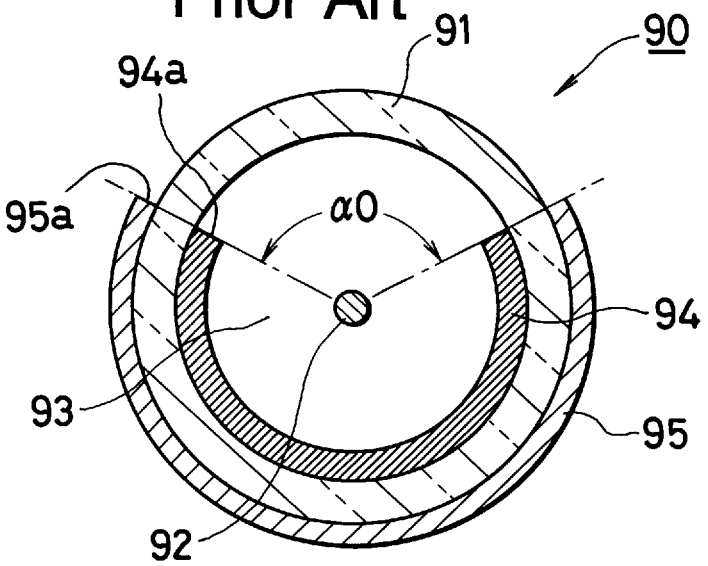
Fig.2 Prior Art
FIG. 2 is a sectional view of a fluorescent lamp according to the prior art.

A detailed description is given based on the result of an experiment conducted by the inventors of the present invention to accomplish the present invention. First, using two glass bulbs 2 having the same outer diameter (9.8 mmΦ), a fluorescent lamp of the prior art (see FIG. 2) and a fluorescent lamp 1 of the present invention in which the opening angles α1 and α2 of a fluorescent layer opening portion 4*a* (reflection layer opening portion 5*a*) and an electrode opening portion 6*a* were set to 75° were prepared for comparison.

As a result, when the same lamp current was applied, the amount of light radiated from the openings in the fluorescent lamp 1 of the present invention was approximately 30% larger than the amount of light emitted from the openings in the fluorescent lamp of the prior art. Since the only difference between them is that the emitted light is reflected by the refection layer 5 or by the external electrode 6 in the fluorescent lamps 1 of the present invention and the prior art, it may be considered that the above improvement in the amount of light radiated from the openings is due to the difference of efficiency between reflection on the inner of the glass bulb 2 and reflection on the outer of the glass bulb 2.

Next, the opening angle α1 of the fluorescent opening portion 4*a* (and the reflection layer opening portion 5*a*) was fixed to 75° and a lamp current to be applied was reduced by increasing the opening angle α2 of the electrode opening portion 6*a* in the fluorescent lamp 1 of the present invention to find the opening angle α2 of the electrode opening portion 6*a* when the amount of light became equal to that of the prior art.

When the opening angle α2 of the electrode opening portion 6*a* was 115°, the amount of the radiated light of the fluorescent lamp 1 of the present invention became equal to that of the fluorescent lamp of the prior art. Namely, the lamp current at this point was approximately 16% smaller than that applied to the fluorescent lamp of the prior art. According to the present invention, the fluorescent lamp 1 can be used with higher brightness due to an increased efficiency, or power consumption can be reduced to obtain the same brightness as that of the prior art and further any desired power consumption can be set.

As described above, since a fluorescent lamp is configured such that a fluorescent layer and a reflection layer are formed on the inner surface of a glass bulb such that the reflection layer is provided at the side of the glass bulb and the opening angle of an opening portion formed in the fluorescent layer and the reflection layer is made smaller than the opening angle of an opening portion formed in the external electrode, the present invention provides an excellent effect that the amount of radiated light can be increased with the same power consumption by improving reflection efficiency, thereby enhancing performance.

Furthermore, the present invention provides another excellent effect that since the independent reflection layer is provided and the external electrode does not need to serve as a reflector the area of the external electrode can be set freely, whereby power consumption is set freely without affecting the distribution characteristics of light radiated from the opening portions and flexibility is given to the design of this type of fluorescent lamp.

While the presently preferred embodiment of the present invention has been shown and described, it is to be understood this disclosure is for the purpose of illustration and that various changes and modifications may be made without departing from the scope of the invention as set forth in the appended claims.

What is claimed is:

1. A fluorescent lamp comprising a tubular glass bulb, an internal electrode provided inside said tubular glass bulb, a fluorescent layer formed on an inner surface of said glass bulb, and an external electrode formed on an outer surface of said glass bulb, wherein opening portions having predetermined opening angles from the center of said glass bulb are formed in said fluorescent layer and said external electrode in an axial direction of said glass bulb at the same position, respectively, said fluorescent lamp further comprises a reflection layer formed on the inner surface of the glass bulb between said fluorescent layer and said glass bulb and having the same area as that of the fluorescent layer, and the opening angle of the opening portions formed in the fluorescent layer and the refection layer is made smaller than that formed in the external electrode.

2. The fluorescent lamp according to claim 1, wherein said reflection layer comprises a dielectric compound.

3. The fluorescent lamp according to claim 2, wherein said dielectric compound is selected from the group consisting of $BaTiO_3$, $TiO_2$, and $BaSO_4$.

4. The fluorescent lamp according to claim 1, wherein said external electrode is made of a material having no reflection function but having an electrode function.

5. The fluorescent lamp according to claim 4, wherein said external electrode is made of a conductive paint.

6. The fluorescent lamp according to claim 3 wherein said external electrode is made of a material having no reflection function but having an electrode function.

7. The fluorescent lamp according to claim 6, wherein said external electrode is made of a conductive paint.

* * * * *